US009989045B2

(12) United States Patent
Alexandrescu

(10) Patent No.: US 9,989,045 B2
(45) Date of Patent: Jun. 5, 2018

(54) MANUAL PISTON AIR PUMP HAVING HIGH FLOW ELECTRIC ROTARY PUMP

(71) Applicant: Vlad Alexandrescu, New Haven, CT (US)

(72) Inventor: Vlad Alexandrescu, New Haven, CT (US)

( * ) Notice: Subject to any disclaimer, the term of this patent is extended or adjusted under 35 U.S.C. 154(b) by 202 days.

(21) Appl. No.: 14/803,734

(22) Filed: Jul. 20, 2015

(65) Prior Publication Data

US 2016/0017879 A1 Jan. 21, 2016

Related U.S. Application Data

(60) Provisional application No. 62/026,680, filed on Jul. 20, 2014, provisional application No. 62/093,612, filed on Dec. 18, 2014, provisional application No. 62/127,265, filed on Mar. 2, 2015, provisional application No. 62/148,246, filed on Apr. 16, 2015.

(51) Int. Cl.

| | |
|---|---|
| ***F04B 33/00*** | (2006.01) |
| ***F04B 41/06*** | (2006.01) |
| ***F04D 25/06*** | (2006.01) |
| ***F04D 17/08*** | (2006.01) |
| ***F04D 25/16*** | (2006.01) |
| ***F04D 29/28*** | (2006.01) |
| ***F04D 29/42*** | (2006.01) |

(52) U.S. Cl.

CPC ..... *F04B 41/06* (2013.01); *F04B 33/00* (2013.01); *F04D 17/08* (2013.01); *F04D 25/0673* (2013.01); *F04D 25/16* (2013.01); *F04D 29/281* (2013.01); *F04D 29/4206* (2013.01)

(58) Field of Classification Search

CPC ..... F04B 41/06; F04B 33/00; F04B 39/1006; F04B 17/06; F04B 23/04; F04B 23/08; F04B 23/10; F04B 23/106; F04B 23/14; F04D 17/08; F04D 25/0673; F04D 25/16; F04D 29/424; F04D 13/12

See application file for complete search history.

(56) References Cited

U.S. PATENT DOCUMENTS

| | | | |
|---|---|---|---|
| 711,654 | A | 10/1902 | Byars |
| 1,379,515 | A | 5/1921 | Bell |
| 3,485,180 | A | 12/1969 | Wickenberg |

(Continued)

*Primary Examiner* — Bryan Lettman
*Assistant Examiner* — Timothy Solak
(74) *Attorney, Agent, or Firm* — Economou Silfin LLP; John S. Economou

(57) ABSTRACT

A triple action air pump includes a manual pump mechanism and an electrical pump mechanism. The mechanical pump mechanism has a piston mounted within a cylindrical housing, a shaft having a first end coupled to the piston and a second end that passes out of the cylindrical housing via an aperture in an end of the cylindrical housing, and a handle coupled to the second end of the shaft. The mechanical pump mechanism operates on both upstrokes and down-strokes of the handle. In one embodiment, the cylindrical housing has a single inner chamber and the electrical pump mechanism is mounted within the same chamber as the piston. In a second embodiment, the cylindrical housing has two separate inner chambers, with the mechanical pump mechanism mounted within one chamber and the electrical pump mechanism mounted within the other chamber.

6 Claims, 5 Drawing Sheets

(56) References Cited

U.S. PATENT DOCUMENTS

| | | | | | |
|---|---|---|---|---|---|
| 5,411,183 | A * | 5/1995 | Hildebrandt | B05B 7/0025 | 141/113 |
| 5,489,197 | A * | 2/1996 | Tsai | F04B 33/00 | 417/526 |
| 5,669,532 | A * | 9/1997 | Dorow | B05B 9/0816 | 222/401 |
| 5,702,239 | A * | 12/1997 | Yang | F04B 33/00 | 417/512 |
| 6,623,249 | B1 * | 9/2003 | Rogers | F04B 41/06 | 417/201 |
| 2003/0086802 | A1 * | 5/2003 | Tsai | F04B 33/00 | 417/546 |
| 2010/0111724 | A1 * | 5/2010 | Chou | F04B 41/06 | 417/366 |

* cited by examiner

MANUAL PISTON AIR PUMP HAVING HIGH FLOW ELECTRIC ROTARY PUMP

FIELD

This invention relates generally to a triple action air pump for use in accurately inflating an inflatable object such as an inflatable kite used for kitesurfing.

BACKGROUND

The world of watersports relies on inflatable toys which hold their shape when inflated to a certain amount of pressure. Kites used for kitesurfing, for example, require in excess of 11 PSI to obtain the required rigidity of the flying wing on such kite. This pressure may be achieved using a generic hand pump such as a bicycle tire pump, however such pumps operate in an inefficient manner given the high number of strokes required for full inflation.

Two-stage electric inflator/compressors may also be used for inflation of inflatable toys. These units typically use an electric impeller element to inflate to a predetermined particular volume and then use a separate compressor element to fully pressurize the object being inflated. Such units require a large heavy power source for the compressor element and are thus not as portable as hand pumps. Additionally, the need for two different inflation elements makes the two-stage unit costly and limits the life expectancy of such units, especially when such units are used in a sandy, salty and wet environment. Finally, such units are limited by the capacity of the power source, with no back-up ability for inflation when the power source runs out of energy.

Accordingly, a need exists in the art for an improved air pump that overcomes the aforementioned problems.

SUMMARY

In a first aspect, a triple action pump includes a body having a hollow cylindrical portion with a first end and a second end. The body also has a base portion closing off the first end of the hollow cylindrical portion and a cap portion closing off the second end of the hollow cylindrical portion. The cap portion has a first aperture and a second aperture. The pump also has a first one-way valve mounted in the first aperture of the cap portion. The first one-way valve configured to allow fluid to pass into an inner portion of the hollow cylindrical portion and to prevent fluid from passing out of the inner portion of the hollow cylindrical portion. The pump further includes a manual pump mechanism having a piston, a hollow shaft and a handle. The piston has a hollow inner chamber, a second one-way valve mounted on an upper portion thereof and a first check valve mounted on a lower portion thereof. The second one-way valve is configured to allow fluid to pass into the hollow inner chamber and to prevent fluid from passing out of the hollow inner chamber. The first check valve is configured to allow fluid to pass into the hollow inner chamber and to prevent fluid from passing out of the hollow inner chamber. The shaft has a hollow inner area, a first end and a second end. The first end of the shaft is coupled to the piston such that the hollow inner area of the shaft is coupled to the hollow inner chamber of the piston. The shaft is positioned such that the piston is within the inner portion of the hollow cylindrical portion of the body. A central portion of the shaft positioned within through the second aperture of the cap. The handle is connected to the second end of the shaft outside of the body with a nozzle mounted on the handle and coupled to the hollow inner area of the shaft. The nozzle is adapted to couple directly to an inflatable device or to an inflatable device via a hose. Finally, the pump includes an electrical pump mechanism. The electrical pump mechanism has a second one-way check valve coupled to an aperture in a wall of the hollow cylindrical portion of the body. The second one-way check valve is configured to allow fluid to pass into the inner portion of the hollow cylindrical portion and to prevent fluid from passing out of the inner portion of the hollow cylindrical portion. The electrical pump mechanism also includes an impeller mechanism comprising an impeller element coupled to an electric motor. The electric motor is coupled to a battery via a switch element. The electric motor is configured to turn the impeller element when the switch element is activated. The impeller element is coupled to the second one-way check valve such that, when the switch is activated and the electric motor turns the impeller element, fluid is drawn into the inner portion of the hollow cylindrical portion via the second one-way check valve. In operation, the triple action pump is configured to output fluid via the nozzle in a manual mode and/or in an electrically-powered mode. The manual mode provides fluid via the nozzle during a down-stroke and an up-stroke of the handle.

Further, the first check valve may be a ball valve. Still further, the ball valve may include a ball stop for increasing fluid flow into the shaft.

In a second aspect, a triple action pump includes a body having a hollow cylindrical portion with a first end and a second end. The body also has a base portion closing off the first end of the hollow cylindrical portion, a cap portion closing off the second end of the hollow cylindrical portion, the cap portion having a first aperture and a second aperture, and an internal wall dividing an inner portion of the hollow cylindrical portion into two separate chambers, a first chamber and a second chamber. The pump also includes a first one-way fluid valve, the first one-way valve mounted in the first aperture of the cap portion and configured to allow fluid to pass into an inner portion of the first chamber of the hollow cylindrical portion and to prevent fluid from passing out of the inner portion of the hollow cylindrical portion. The pump further includes a manual pump mechanism having a piston, a shaft and a handle. The piston has a hollow inner chamber, a second one-way valve mounted on an upper portion thereof and a first check valve mounted on a lower portion thereof. The second one-way valve is configured to allow fluid to pass into the hollow inner chamber and to prevent fluid from passing out of the hollow inner chamber. The first check valve is configured to allow fluid to pass into the hollow inner chamber and to prevent fluid from passing out of the hollow inner chamber. The shaft has a hollow inner area, a first end and a second end. The first end of the shaft is coupled to the piston such that the hollow inner area of the shaft is coupled to the hollow inner chamber of the piston and positioned such that the piston is within the inner portion of the first chamber of the hollow cylindrical portion of the body, a central portion of the shaft positioned within through the second aperture of the cap. The handle is connected to the second end of the shaft outside of the body with a nozzle mounted on the handle and coupled to the hollow inner area of the shaft. The nozzle is adapted to couple directly to an inflatable device or to an inflatable device via a hose. The pump finally includes an electrical pump mechanism mounted within the second chamber of the hollow cylindrical portion of the body. The electrical pump mechanism has an impeller housing having one portion coupled to an aperture in a wall of the hollow cylindrical portion of the body and another portion coupled to a third one-way valve mounted in the internal wall. The third one-way valve is configured to allow fluid to pass from the impeller housing into an inner portion of the first chamber of the hollow cylindrical portion and to prevent fluid from passing out of the inner portion of the hollow cylindrical portion. Finally, the electrical pump mechanism includes an impeller mechanism having an impeller element coupled to an electric motor. The electric motor is coupled to a battery via a switch element. The electric motor is configured to turn the impeller element when the switch element is activated. The impeller element is mounted on a wall of the impeller housing such that, when the switch is activated and the electric motor turns the impeller element, fluid is drawn into the impeller housing and then out of the impeller housing and into the first chamber through the third one-way valve. During operation, the triple action pump is configured to output fluid via the nozzle in a manual mode and/or in an electrically-powered mode, the manual mode providing fluid via the nozzle during a down-stroke and an up-stroke of the handle.

Further, the first check valve may be a ball valve. Still further, the ball valve may include a ball stop for increasing fluid flow into the shaft.

The features, functions, and advantages that have been discussed can be achieved independently in various embodiments or may be combined in yet other embodiments, further details of which can be seen with reference to the following description and drawings.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION

In the present disclosure, like reference numbers refer to like elements throughout the drawings, which illustrate various exemplary embodiments of the present invention.

Figure 1:
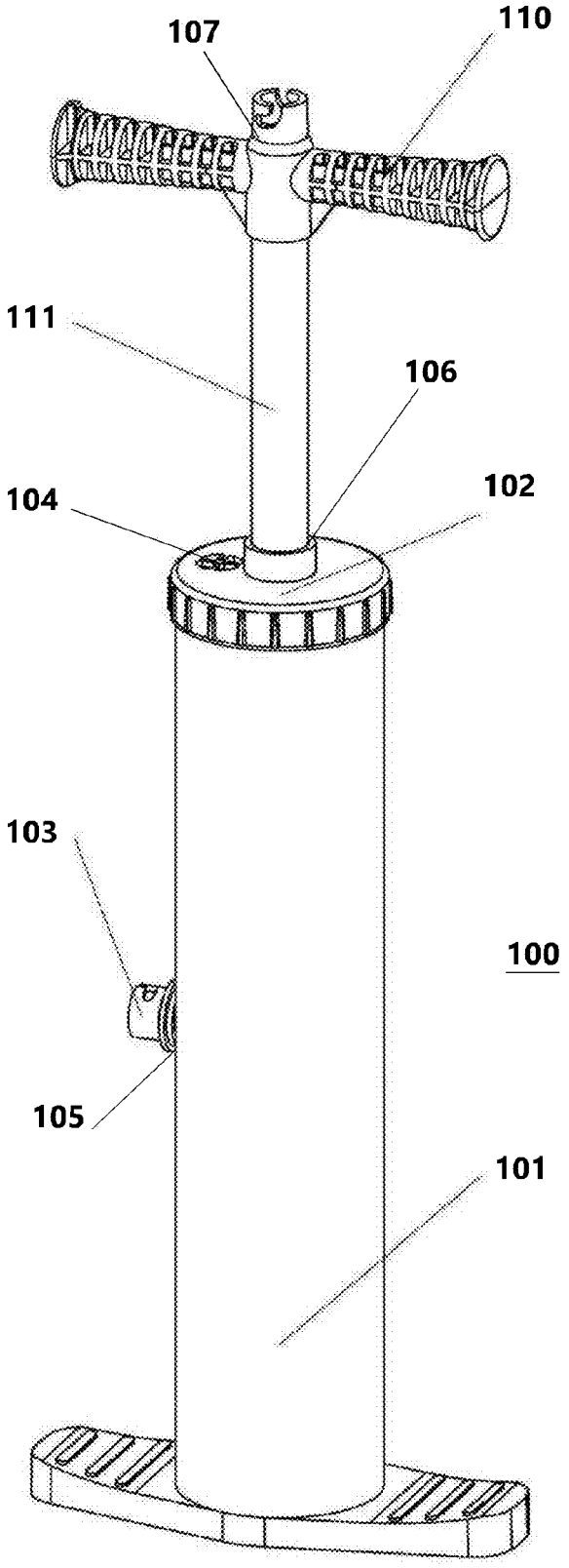
FIG. 1 is a perspective view of an air pump constructed in accordance with a first embodiment of the present invention.

Referring now to FIG. 1, in a first embodiment, a triple action pump 100 includes a cylindrical hollow reservoir housing (i.e., a pump body) 101. A side intake port 103 is connected to an aperture 105 in pump body 101. A cap 102 is coupled to an upper end of pump body 101. A cap intake aperture 104 is included in cap 102, with a one-way check valve 171 installed in aperture 104 (shown in detail in FIG. 4). An elongated piston shaft 111 extends along a longitudinal axis of pump body 101 and protrudes through an aperture 106 in cap 102. A handle 110 is perpendicularly disposed with respect to piston shaft 111 to assist pumping of piston shaft 111. A nozzle 107 is provided in handle 110 for coupling to an inflatable object, either directly or via an air hose with appropriate fittings.

Figure 2:
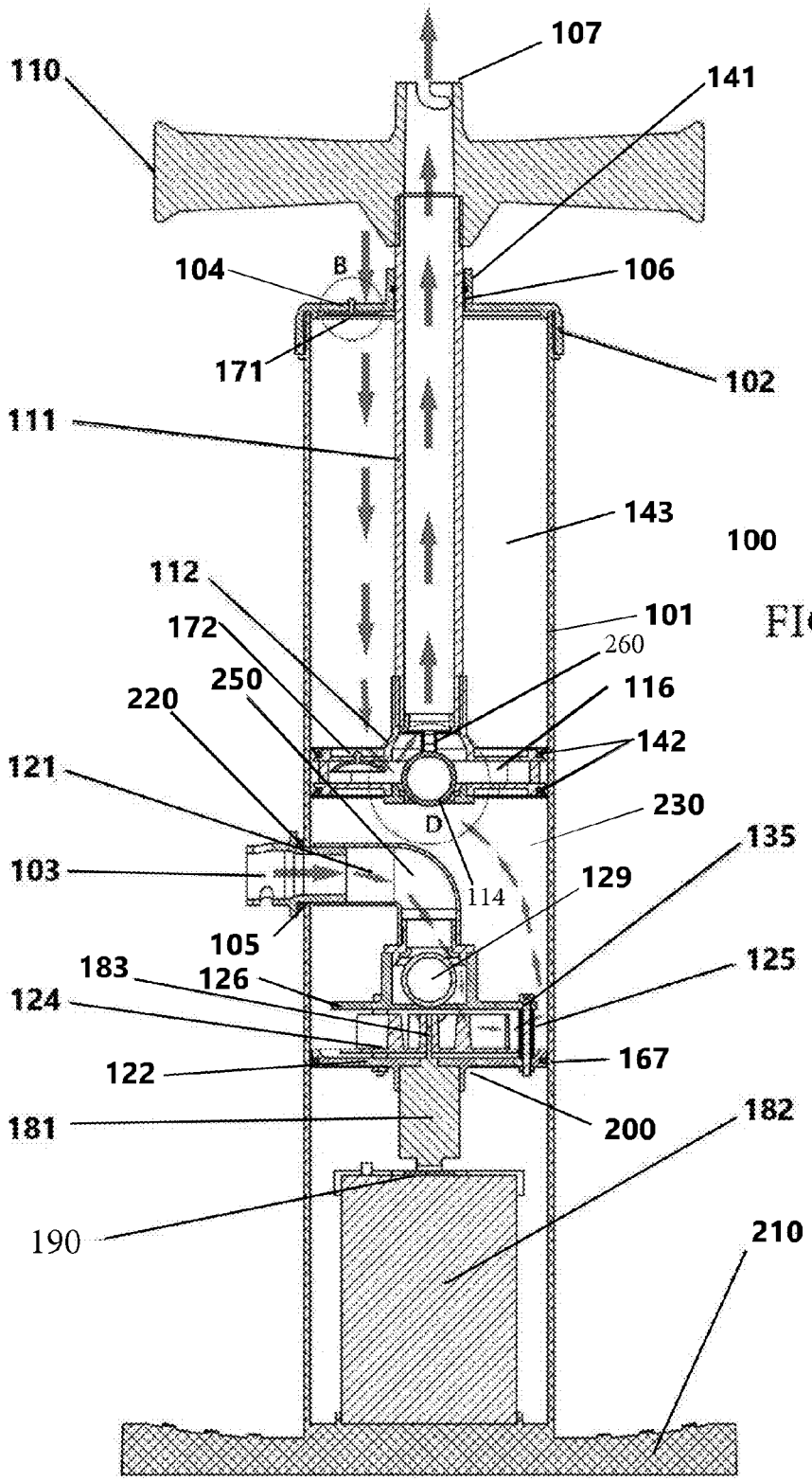
FIG. 2 is a cross-sectional view of the air pump of the first embodiment of the present invention.

Referring now to FIG. 2, an impeller body assembly 200 is mounted inside and preferably on a base 210 of pump body 101. Impeller body assembly 200 is coupled to the environment outside of pump body 101 via side intake port 103. A seal 220 is provided between side intake port 103 and an inner (lower) chamber 230 of pump body 101. Seal 220 is provides an air-tight coupling between the outer environment and inner chamber 230 and may be any kind of appropriate gasket, for example, a rubber O-ring. Impeller body assembly 200 includes a battery 182 mounted in a slot in base 210. Battery 182 may be held in place by an adhesive, for example. A battery support member 190 is mounted above battery 182. Battery support member 190 may be secured in place by an elastic member 128 (note this isn't shown in the drawing) or appropriate adhesives. The battery support member 190 provides a mounting area for an electric motor 181, which is coupled to battery 182 in a conventional manner. A lower impeller support 122 is mounted above battery 182 and includes a rubber seal 167 to isolate an upper portion of inner chamber 230 (i.e., the area above lower impeller support 122) from a lower portion thereof (i.e., the area below lower impeller support 122). Motor 181 includes a motor shaft 183 which passes through a center aperture in lower impeller support 122. Lower impeller support 122 is secured to motor 181 using screws or in another conventional manner. An impeller element 124 is coupled to motor shaft 183 using adhesive or a press fit-type coupling. An upper impeller support 126 is mounted above impeller element 124 via screws mounted in apertures in upper impeller support 126 that connect to lower impeller support 122. Upper impeller support 126 includes a centered vent chamber, detailed in FIG. 3, discussed below, that is coupled to side intake port 103 via a curved pipe 250, with a ball valve 129 (or other type of check valve) included within the vent chamber.

Figure 3:
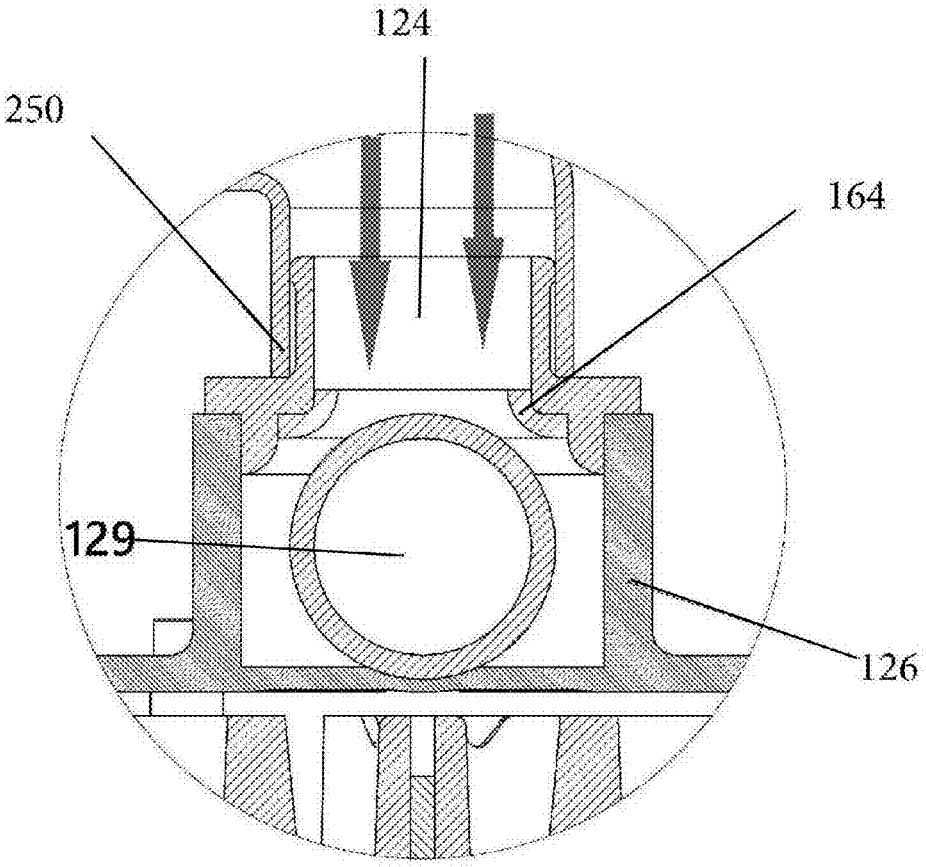
FIG. 3 is an enlarged cross-sectional view of a first portion of the air pump of the first embodiment of the present invention showing the details of the piston ball valve.

Referring now to FIG. 3, an enlarged view of the vent chamber is shown. Ball valve 129 is positioned in the vent chamber in a connecting member 124 that couples the chamber to a curved pipe 250. A seal 164 is positioned above ball valve 129. Ball valve 129 rests on support 126 and moves against seal 164 during certain portions of pumping, as discussed herein, to prevent air from escaping out of side intake port 103, during a manual down-stroke, for example.

Figure 4:
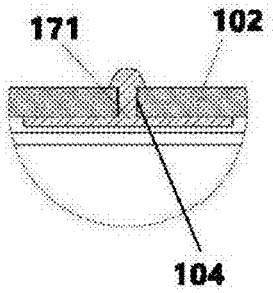
FIG. 4 is an enlarged cross-sectional view of a second portion of the air pump of the first embodiment of the present invention showing the details of the impeller body top valve.

Referring now to FIG. 4, an enlarged view of check valve 171 installed in aperture 104 of cap 102 is provided. Check valve 171 provides for the intake of air during manual pumping mode.

Referring back to FIG. 2, aperture 106 is a piston extruded hole in a center portion of cap 102 with a tolerated diameter equal to a diameter of the piston shaft 111 to allow free movement of shaft 111 along the vertical axis. A small seal 141 may be installed in a small inner groove to provide an air-tight connection between piston shaft 111 and aperture 106 while performing up-stroke and down-stroke movements of shaft 111 (i.e., during manual pumping). A piston 112 is mounted on a lower end of piston shaft 111, using, for example, matching threads. An outside diameter of piston 112 is slightly smaller than an inner diameter of the pump body 101 to allow piston 112 to move freely on the vertical axis during manual pumping. Piston 112 is hollow and the internal hollow portion provides a chamber facilitating a flow of air from both the area 143 above piston 112 and the area 230 below piston 112 through the piston 112 and into piston shaft 111. Piston 112 includes a hollow inner chamber 116 and has two outer seals 142 which provide an air-tight seal between the upper reservoir chamber 143 and the lower reservoir chamber 230. A one way check valve 172 is mounted on a top surface of piston 112 and a one-way ball valve 114 (or other type of check valve) is mounted on a lower surface of piston 112. One-way ball valve 114 is configured to allow airflow into the hollow shaft 111 during a down-stroke of shaft 111 and to prevent airflow from escaping into chamber 230 during an up-stroke of shaft 111. In particular, ball-valve 114 includes a ball stop 260 which aids in providing higher capacity air flow into shaft 111 than in prior art solutions.

In manual mode of operation, air in the upper chamber 143 is compressed during an upstroke and exhausted through check valve 172 as the lower chamber 230 fills with air received from the side intake port 103. Concurrently, piston ball valve 114 presses against seal 164 due to gravitational force and air pressure within chamber 116 (caused by air entering via check valve 172) thereby preventing air from upper chamber 143 from leaking into the lower chamber 230. The compressed air from the upper chamber 143 passes through the piston valve 172, into inner chamber 116 of piston 112, around ball valve 114 (again, in a lower position), and into the hollow center of the shaft 111 and then into an inflatable object, either directly via nozzle 107 or via a hose attached to nozzle 107. During a down-stroke, air in the lower chamber 230 is compressed and exhausted through ball valve 114 and into chamber 116 inside the piston 112. Concurrently, the upper chamber 143 fills with air received via intake port 104 located on cap 102, while ball valve 129 closes preventing air from escaping from lower chamber 230. At the same time, the piston cap valve 171 opens, allowing air to enter the upper chamber 143. The compressed air inside the lower chamber 230 moves around the piston ball valve 114, into the hollow center of the shaft 111 and then into an inflatable object, either directly via nozzle 107 or via a hose attached to nozzle 107.

In the electro-assist mode of operation, the motor is activated using a switch (not shown) that connects the battery 182 to the electric motor 181. Electric motor 181 turns, spinning impeller 124, which action draws air in to chamber 230 via side intake port 103 and ball valve 129 (which opens due to the air pressure caused by the spinning impeller 124). Shaft 11 remains motionless during this mode of operation, and thus valves 171, 172 remain closed. As air pressure increases in chamber 230 due to the rotation of impeller 124 air moves through the exhaust ball valve 114 located in the piston 112, into the hollow center of the shaft 111 and then into an inflatable object, either directly via nozzle 107 or via a hose attached to nozzle 107. It is to be noted that the embodiment shown in FIGS. 1 to 4 illustrates a presently embodiment of the pump of the present disclosure.

Figure 5:
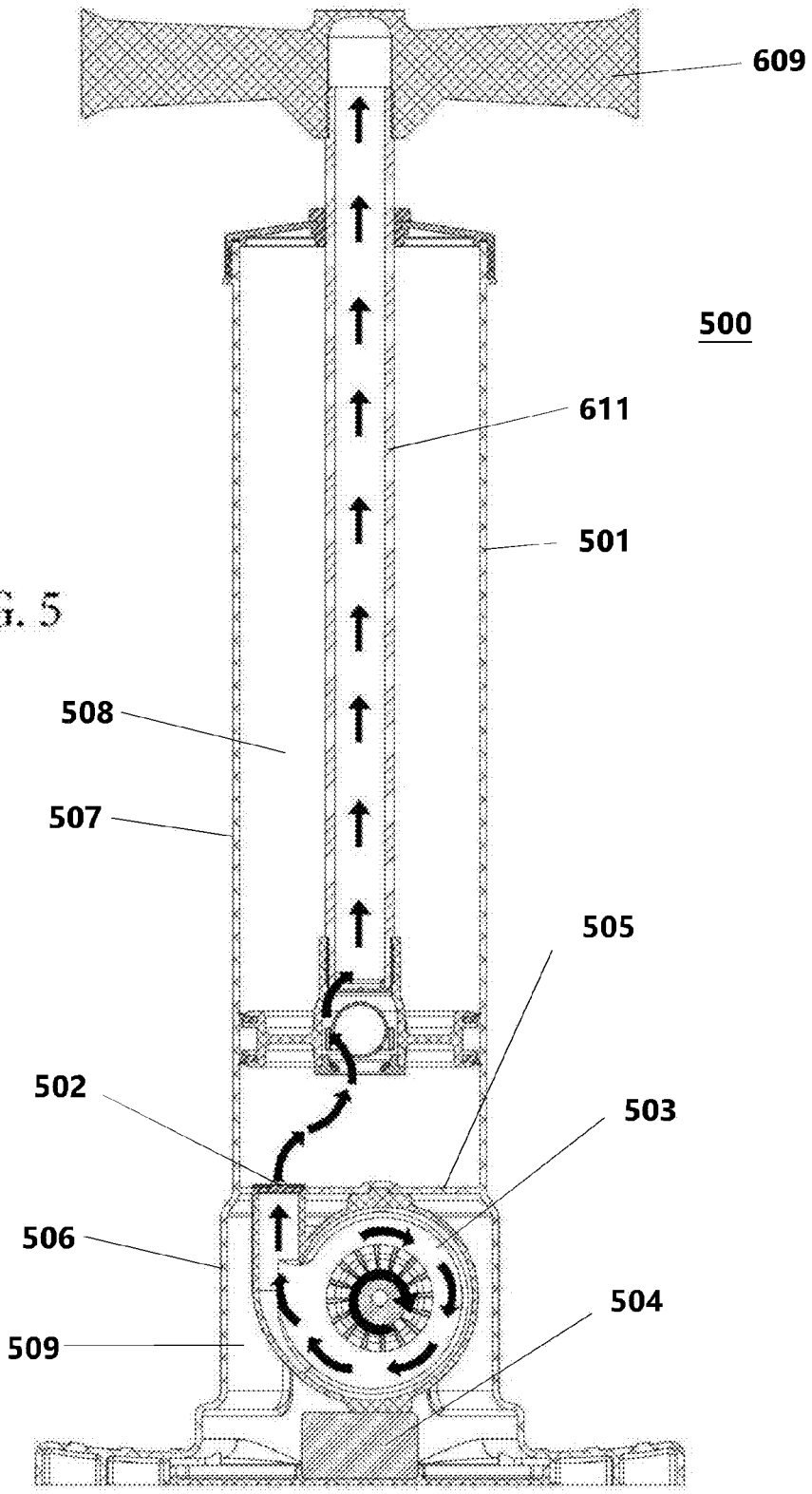
FIG. 5 is a front cross-sectional view of a second embodiment of the present invention.

Referring now to FIG. 5, an alternative embodiment of a triple action pump 500 in which an electric impeller body assembly 503 is housed in a base portion 506 of a cylindrical hollow reservoir housing or pump body 501. In this embodiment, reservoir housing 501 is divided by a wall 505 into an upper portion 507 with an inner chamber 508 and a lower portion 506 with an inner chamber 509. Wall 505 includes a mounting support for impeller body assembly 503 and a one-way flapper-style valve 502 that allows air to pass from the exhaust valve portion of impeller 503 into chamber 508, but prevents air from exiting from chamber 508 through wall 505.

Figure 6:
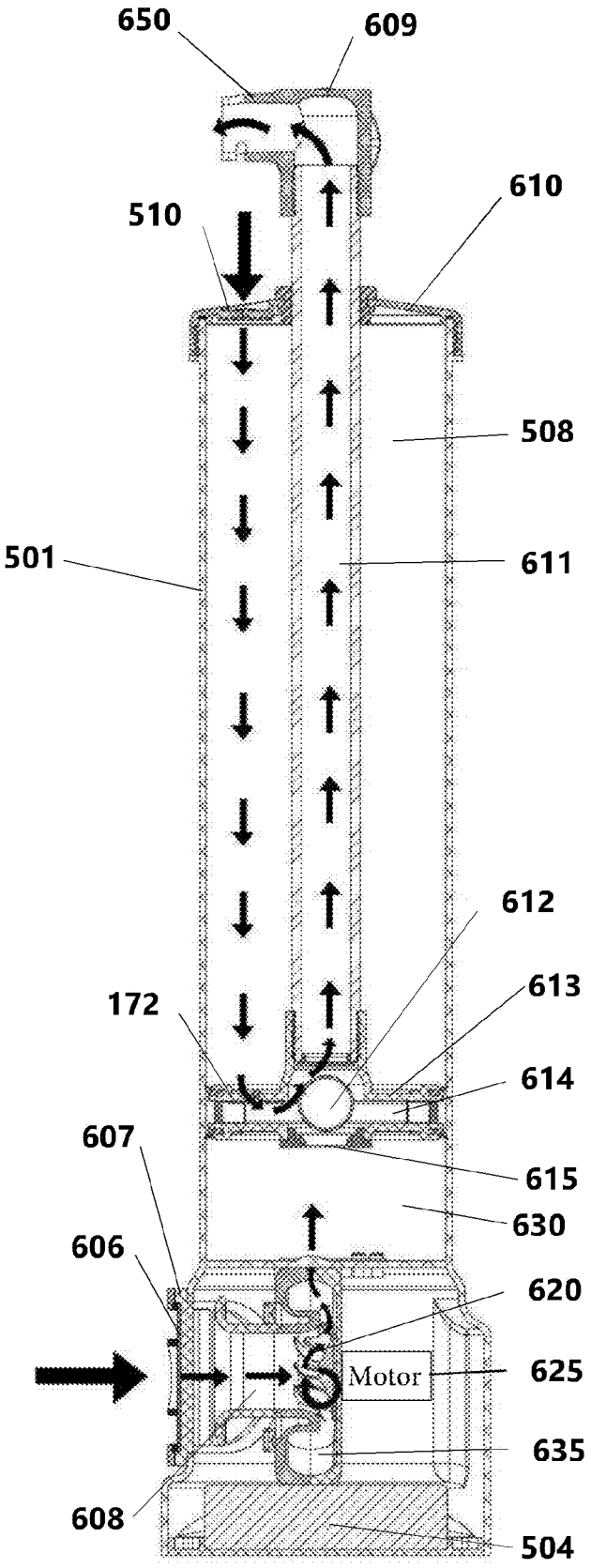
FIG. 6 is a side cross-sectional view of the second embodiment triple action pump of the present invention.

Referring now to FIG. 6, the lower chamber 509 houses the electric impeller body assembly 503 and a corresponding power source (e.g., a battery) 504. A filter assembly 606 is mounted on an intake hole of pump body 501 adjacent to an impeller body intake portion 608. Filter assembly 606 has an outer shell 607. Impeller body assembly 502 has an impeller element 620 inside an impeller body 635. Impeller body 635 is preferably formed as a volute shell 635. Impeller element 620 is fixed onto a shaft of an electric motor 625. Electric motor 625 is mounted on an opposite side of impeller body 635 as impeller element 620. A piston 613 is coupled to a first end of a piston shaft 611 in upper chamber 508. Piston shaft 611 which protrudes through a cap 610. A handle 609 is mounted at a second end of piston shaft 611, opposite the first end thereof. Piston 613 is configured in the same manner as piston 112 of the first embodiment, with a valve 172 on an upper portion of piston 613 that allows air to pass from upper chamber 508 to an inner chamber 614 of piston 613 but prevents air from passing from inner chamber 614 to upper chamber 508. Piston 613 also includes a ball valve 612 (or other type of check valve) that, in one position (lower) (e.g., during a manual upstroke), air passes from upper chamber 508, through valve 172 and into chamber 614, and then around ball valve 612 and into the internal hollow portion of shaft 611. In the other position, (e.g., during a manual down-stroke), air passes from the reservoir area 630 below piston 613 into chamber 614 and around ball valve 612 and into the internal hollow portion of shaft 611. Although, not show, ball valve 612 may include a ball stop like ball stop 260 shown in FIG. 2.

During the manual operation mode of pump 500, in an upstroke of shaft 611, air in the upper reservoir 508 above piston 613 is compressed and exhausted through check valve 172, by ball valve 612 and into the hollow portion of shaft 611. Once air moves into the hollow internal portion of shaft 611, air then moves into an inflatable object, either directly via a nozzle 650 on handle 609 or via a hose attached to nozzle 650. Also during an upstroke of shaft 611, the lower reservoir 630 receives air via the one-way flapper-style valve 502 in dividing wall 505. As discussed above, piston ball valve 612 prevents air from leaking into the lower reservoir chamber 630 during an upstroke of shaft 611

During manual operation mode of pump 500, in a down-stroke of shaft 611, air in lower reservoir 630 is compressed and forced around the exhaust ball valve 612 located inside piston 613. In particular, as shaft 611 moves piston 613 downwards, the upper reservoir chamber 620 fills with air received from intake port 510 located on the cap 610. Flapper-style intake valve 502 (see FIG. 5) blocks air in lower reservoir 630 from passing through such valve 502 during a down-stroke, ensuring that all air in lower reservoir instead passes into the hollow portion of shaft 611. Also, as shaft 611 moves piston 613 downwards, piston cap valve 510 opens and thus allows air to enter the upper reservoir 508. In summary, during a down-stroke of shaft 511, air in lower reservoir 630 compresses and is forced around the piston ball valve 612 and into the hollow portion of shaft 611. Once air moves into the hollow internal portion of shaft 611, air then moves into an inflatable object, either directly via a nozzle 650 on handle 609 or via a hose attached to nozzle 650.

In the electro-assist mode of operation of pump, a switch (not shown) and associated circuitry are used to activate electric motor 625 to spin impeller 620. The action of spinning impeller 620 draws air inside the impeller body shell 635 through the side intake port of filter assembly 606. Valves 510 and 172 remain in a default closed position during this mode of operation. The spinning impeller 620 forces air into lower reservoir 630, increasing air pressure therein until air moves through the exhaust ball valve 612 located on the piston 613 and then into the hollow portion of shaft 611. Once air moves into the hollow internal portion of shaft 611, air then moves into an inflatable object, either directly via a nozzle 650 on handle 609 or via a hose attached to nozzle 650.

The present disclosure describes two embodiments of a triple action pump which may be used to pump air or other fluids. In both embodiments, a user may engage the electro-assist mode which may be used initially to inflate an inflatable device to a first level of inflation. Thereafter, in the manual mode, a user may pump the handle to further inflate the inflatable device to a desired final level of inflation. The manual mode moves air into the inflatable device during both upstrokes and down-strokes, providing more efficiency. The embodiments of the present disclosure are lighter and more easily transportable, because the motor and battery required to provide the electro-assist mode are smaller and less expensive than two-stage air pumps which only operate on battery power (since a lower threshold of inflation is required). In addition, the embodiments of the present disclosure also provide the advantage of a purely manual mode (and continued operation) in the event that the battery becomes discharged or other problems with the electrical system. An air pump that operates only on electricity becomes inoperable in such circumstances.

Although the present invention has been particularly shown and described with reference to the preferred embodiments and various aspects thereof, it will be appreciated by those of ordinary skill in the art that various changes and modifications may be made without departing from the spirit and scope of the invention. It is intended that the appended claims be interpreted as including the embodiments described herein, the alternatives mentioned above, and all equivalents thereto.

What is claimed is:

1. A triple action pump, comprising:

a body comprising:

a hollow cylindrical portion having a first end and a second end, a base portion closing off the first end of the hollow cylindrical portion, and a cap portion closing off the second end of the hollow cylindrical portion, the cap portion having a first aperture and a second aperture;

a first one-way valve, the first one-way valve mounted in the first aperture of the cap portion and configured to allow fluid to pass into an inner portion of the hollow cylindrical portion and to prevent fluid from passing out of the inner portion of the hollow cylindrical portion;

a manual pump mechanism comprising:

a piston having a hollow inner chamber, a second one-way valve mounted on an upper portion thereof and a first check valve mounted on a lower portion thereof, the second one-way valve configured to allow fluid to pass into the hollow inner chamber and to prevent fluid from passing out of the hollow inner chamber, the first check valve configured to allow fluid to pass into the hollow inner chamber and to prevent fluid from passing out of the hollow inner chamber, a shaft having a hollow inner area, a first end and a second end, the first end of the shaft coupled to the piston such that the hollow inner area of the shaft is coupled to the hollow inner chamber of the piston and positioned such that the piston is within the inner portion of the hollow cylindrical portion of the body, a central portion of the shaft positioned within the second aperture of the cap, and a handle connected to the second end of the shaft outside of the body with a nozzle mounted on the handle and coupled to the hollow inner area of the shaft, the nozzle adapted to couple directly to an inflatable device or to an inflatable device via a hose; and an electrical pump mechanism mounted within the body comprising:

a second one-way check valve coupled to an aperture in a wall of the hollow cylindrical portion of the body, the second one-way check valve configured to allow fluid to pass into the inner portion of the hollow cylindrical portion and to prevent fluid from passing out of the inner portion of the hollow cylindrical portion, and an impeller mechanism arranged within the body comprising an impeller element coupled to an electric motor, the electric motor coupled to a battery via a switch element, the electric motor configured to turn the impeller element when the switch element is activated, the impeller element coupled to the second one-way check valve such that, when the switch is activated and the electric motor turns the impeller element, fluid is drawn into the inner portion of the hollow cylindrical portion via the second one-way check valve;

wherein the triple action pump is configured to output fluid via the nozzle in a manual mode and/or in an electrically-powered mode, the manual mode providing fluid via the nozzle during a down-stroke and an up-stroke of the handle.

2. The triple action pump of claim 1, wherein the first check valve is a ball valve.

3. The triple action pump of claim 2, where the ball valve includes a ball stop to aid in increasing fluid flow into the shaft.

4. A triple action pump, comprising:

a body comprising:

a hollow cylindrical portion having a first end and a second end, a base portion closing off the first end of the hollow cylindrical portion, a cap portion closing off the second end of the hollow cylindrical portion, the cap portion having a first aperture and a second aperture, and an internal wall dividing an inner portion of the hollow cylindrical portion into two separate chambers, a first chamber and a second chamber;

a first one-way valve, the first one-way valve mounted in the first aperture of the cap portion and configured to allow fluid to pass into an inner portion of the first chamber of the hollow cylindrical portion and to prevent fluid from passing out of the inner portion of the first chamber of the hollow cylindrical portion;

a manual pump mechanism comprising:

a piston having a hollow inner chamber, a second one-way valve mounted on an upper portion thereof and a first check valve mounted on a lower portion thereof, the second one-way valve configured to allow fluid to pass into the hollow inner chamber and to prevent fluid from passing out of the hollow inner chamber, the first check valve configured to allow fluid to pass into the hollow inner chamber and to prevent fluid from passing out of the hollow inner chamber, a shaft having a hollow inner area, a first end and a second end, the first end of the shaft coupled to the piston such that the hollow inner area of the shaft is coupled to the hollow inner chamber of the piston and positioned such that the piston is within the inner portion of the first chamber of the hollow cylindrical portion of the body, a central portion of the shaft positioned within the second aperture of the cap, and a handle connected to the second end of the shaft outside of the body with a nozzle mounted on the handle and coupled to the hollow inner area of the shaft, the nozzle adapted to couple directly to an inflatable device or to an inflatable device via a hose; and an electrical pump mechanism mounted within the second chamber of the hollow cylindrical portion of the body, comprising:

an impeller housing having one portion coupled to an aperture in a wall of the hollow cylindrical portion of the body and another portion coupled to a third one-way valve mounted in the internal wall, the third one-way valve configured to allow fluid to pass from the impeller housing into an inner portion of the first chamber of the hollow cylindrical portion and to prevent fluid from passing out of the inner portion of the first chamber of the hollow cylindrical portion, and an impeller mechanism arranged within the second chamber of the hollow cylindrical portion of the body comprising an impeller element coupled to an electric motor, the electric motor coupled to a battery via a switch element, the electric motor configured to turn the impeller element when the switch element is activated, the impeller element mounted on a wall of the impeller housing such that, when the switch is activated and the electric motor turns the impeller element, fluid is drawn into the impeller housing and then out of the impeller housing and into the first chamber through the third one-way valve;

wherein the triple action pump is configured to output fluid via the nozzle in a manual mode and/or in an electrically-powered mode, the manual mode providing fluid via the nozzle during a down-stroke and an up-stroke of the handle.

5. The triple action pump of claim 4, wherein the first check valve is a ball valve.

6. The triple action pump of claim 5, where the ball valve includes a ball stop to aid in increasing fluid flow into the shaft.

* * * * *